US006155731A

United States Patent [19]

Bertalan et al.

[11] Patent Number: 6,155,731

[45] Date of Patent: Dec. 5, 2000

[54] PRINTING APPARATUS WITH COVER ACTUATED DRIVE SOURCE

[75] Inventors: John Bertalan; Jeffery C. Cooper, both of Riverton, Wyo.; Bernard V. Masson, Nicholasville, Ky.; James S. Carter, Denver, Colo.; Jimmy R. Rowe, Riverton, Wyo.; Russel Hugh Marvin, Voorheesville, N.Y.

[73] Assignee: Axiohm Transaction Solutions, Inc., San Diego, Calif.

[21] Appl. No.: 08/953,085

[22] Filed: Oct. 17, 1997

[51] Int. Cl.[7] ..... B41J 11/26

[52] U.S. Cl. ..... 400/621; 400/54; 400/55; 101/227; 101/711; 101/569; 101/472

[58] Field of Search ..... 400/621, 615.2, 400/613, 208, 569, 605, 611, 636, 692, 472, 55, 54, 711; 101/288, 226, 227

[56] References Cited

U.S. PATENT DOCUMENTS

| | | | |
|---|---|---|---|
| 4,042,939 | 8/1977 | Lloyd et al. . | |
| 4,184,063 | 1/1980 | Heiling et al. | 400/613 |
| 4,297,039 | 10/1981 | Lees . | |
| 4,312,597 | 1/1982 | Shimizu et al. | 400/621 |
| 4,560,990 | 12/1985 | Sue et al. . | |
| 4,562,444 | 12/1985 | Nagashima et al. . | |
| 4,568,950 | 2/1986 | Ross et al. . | |
| 4,632,585 | 12/1986 | Oyamatsu et al. | 400/692 |
| 4,639,739 | 1/1987 | Tsutsumi . | |
| 4,663,638 | 5/1987 | Hirose . | |
| 4,982,337 | 1/1991 | Burr et al. | 400/621 |
| 5,000,595 | 3/1991 | Koike et al. | 400/613 |
| 5,122,005 | 6/1992 | Kamei | 400/692 |
| 5,168,814 | 12/1992 | Kuzuya et al. | 400/636 |
| 5,201,588 | 4/1993 | Sakai et al. | 400/613 |
| 5,447,379 | 9/1995 | Pou . | |
| 5,570,962 | 11/1996 | Suzuki . | |
| 5,579,043 | 11/1996 | Patry . | |
| 5,741,082 | 4/1998 | Toya | 400/621 |
| 5,791,796 | 8/1998 | Gustavsson et al. | 400/613 |
| 5,806,993 | 9/1998 | Petterutti et al. | 400/613 |
| 5,876,129 | 3/1999 | Suzuki | 400/636 |

FOREIGN PATENT DOCUMENTS

| | | | |
|---|---|---|---|
| 000534799 | 3/1993 | European Pat. Off. | 400/621 |
| 2 708 521 | 2/1995 | France . | |
| 3306083 | 2/1983 | Germany . | |
| 3402067 | 1/1984 | Germany . | |
| 3438663 | 10/1984 | Germany . | |
| 3509218 | 3/1985 | Germany . | |
| 3509414 | 3/1985 | Germany . | |
| 3417380 | 11/1985 | Germany | 400/621 |
| 4039513 | 12/1990 | Germany . | |
| 55-139278 | 10/1980 | Japan . | |

(List continued on next page.)

OTHER PUBLICATIONS

IBM Tech. Discl. Bulletin, "Compact Paper Guillotine." vol. 26, No. 8, Jan. 1984, pp. 4192–4193.

*Primary Examiner*—Eugene Eickholt
*Attorney, Agent, or Firm*—Watts, Hoffman, Fisher & Heinke Co., L.P.A.

[57] ABSTRACT

A printer in which loading of print media is greatly facilitated and in which modular construction is used in order to substantially reduce the number of parts normally needed for this type of printer. The printer includes a base and an associated cover that encloses an interior region of the printer. The cover is movable between opened and closed positions and mounts a spring biased platen roller which is engageable with a printhead fixed in the base, when the cover is closed. A cutter mechanism, including a fixed blade mounted to the cover and a reciprocating blade mounted in the base also separates whenever the cover is opened in order to further facilitate print media loading. The printhead is secured to a printhead mounting and control module which also includes componentry and circuitry needed to drive the printhead. The module which may be in the form of a circuit board assembly also mounts control switches which are actuatable by other printer structure or by buttons that are accessible from the exterior of the printer. A resilient alignment mechanism is used to promote uniform cutting contact between the fixed blade and reciprocating blade when the cover is closed.

48 Claims, 13 Drawing Sheets

FOREIGN PATENT DOCUMENTS

| | | | |
|---|---|---|---|
| 59-31177 | 2/1984 | Japan . | |
| 0133085 | 7/1984 | Japan | 400/613 |
| 0280065 | 12/1987 | Japan | 400/613 |
| 401097670A | 4/1989 | Japan | 400/55 |
| 406198988A | 7/1994 | Japan | 400/621 |
| 2 226 794 | 7/1990 | United Kingdom . | |
| 2 250 478 | 6/1992 | United Kingdom . | |
| WO 94/11197 | 3/1994 | WIPO . | |

PRINTING APPARATUS WITH COVER ACTUATED DRIVE SOURCE

This application is based on a provisional application No. 60/028,780 filed Oct. 18, 1996.

TECHNICAL FIELD

The present invention relates generally to printers and, in particular, to a compact, clam shell style printer that is easily loaded and includes a construction that minimizes the cabling required between a printhead, control switches and connectors, and the associated circuit board.

BACKGROUND ART

Printers of the type to which this invention pertains have many applications and uses. They may be used as part of a point-of-sale terminal to print receipts, etc. Printers of this type may also be used to generate labels on which alphanumeric characters or symbology, i.e., barcodes are printed.

These types of printers often utilize thermal print technology to print indicia on print medium. Thermal printing involves a thermal printhead which uses heating elements to produce localized heating on thermal reactive print media to produce indicia on the print media. In order to effect the printing process, the print medium must be clamped between a platen and the thermal printhead. The printhead is normally spring biased towards the print roller in order to provide the required clamping force.

DISCLOSURE OF INVENTION

The present invention provides a new and improved printer apparatus in which the loading of print media is greatly facilitated and, in which modular construction is used in order to substantially reduce the number of parts normally needed for this type of printer.

According to the invention, the printing apparatus includes a base and an associated cover for enclosing an interior region of the apparatus. The cover is movable between opened and closed positions. When the cover is closed, the printing apparatus defines a print media path that extends from the interior region to a discharge opening. The platen roller is rotatably supported by the cover, such that when the cover is moved to its opened position, the platen roller is spaced from the print media path. A substantially fixed printhead is supported by the base and is engageable by the platen roller when the cover is in its closed position. A biasing arrangement urges the platen roller towards the printhead when the cover is in its closed position.

According to a feature of this embodiment, a cutter mechanism forms part of the printing apparatus and has one portion carried by the cover and another portion carried by the base, such that when the cover is moved to its opened position, the one portion of the cutter mechanism moves to a spaced location along with the platen roller to facilitate the loading of print media into the printing apparatus.

According to the preferred and illustrated embodiment of the invention, the printing apparatus also includes a thermal printhead which together with associated control components and electronics forms a printhead and control module that is mounted within the printing apparatus. The control module preferably comprises a circuit board assembly to which the thermal printhead is secured and is fixed relative to the base.

According to this feature of the invention, the circuit board assembly also mounts one or more switches which provide a cover position detector function, as well as a print media advancement function. According to a further feature of this aspect of the invention, the circuit board assembly also mounts connectors by which the printer is interfaced to other equipment.

In the preferred and illustrated embodiment, the printer incorporates a clam shell design in which a pivotally mounted cover mounts a spring biased platen roller. When the cover is opened, a print media compartment is exposed, as well as the complete media feed path. Print media is installed in the printer by placing the print media supply in a compartment defined within the printer and then pulling the lead end of the print media so that it extends beyond an ejection point in the printing apparatus. Closing the cover causes the platen roller to re-engage the printhead thus clamping the print media between itself and the printhead.

In the illustrated embodiment, the printer includes a cutter in which a portion is carried by the cover and another portion is mounted in the base. With this construction, opening the cover also separates the cutter elements so that print media need not be fed through a cutter mechanism when the print media is loaded. In the illustrated embodiment, the one cutter portion comprises a fixed blade that is attached to and is movable with the cover. The other portion of the cutter includes a reciprocally movable blade and is located in the base unit. In the preferred embodiment, one of the cutter portions is resiliently biased to the other portion when the cover is closed. This biasing urges the cutter portions into an aligned relationship to promote uniform blade contact in order to improve cutter performance.

The disclosed printer is compact and is easily manufactured. Cabling normally required between the printhead, the control switches, the connectors and the associated circuit board, is eliminated or at least substantially reduced. In addition, the susceptibility of damage to the electronics of the printer due to electrostatic discharge is substantially reduced since the electronic control module assembly is located entirely within the printer and except for the interface connectors is not accessible from outside the printer.

Additional features of the invention will become apparent and a fuller understanding obtained by reading the following detailed description made in connection with the accompanying drawings.

BEST MODE FOR CARRYING OUT THE INVNTION

Figure 1:
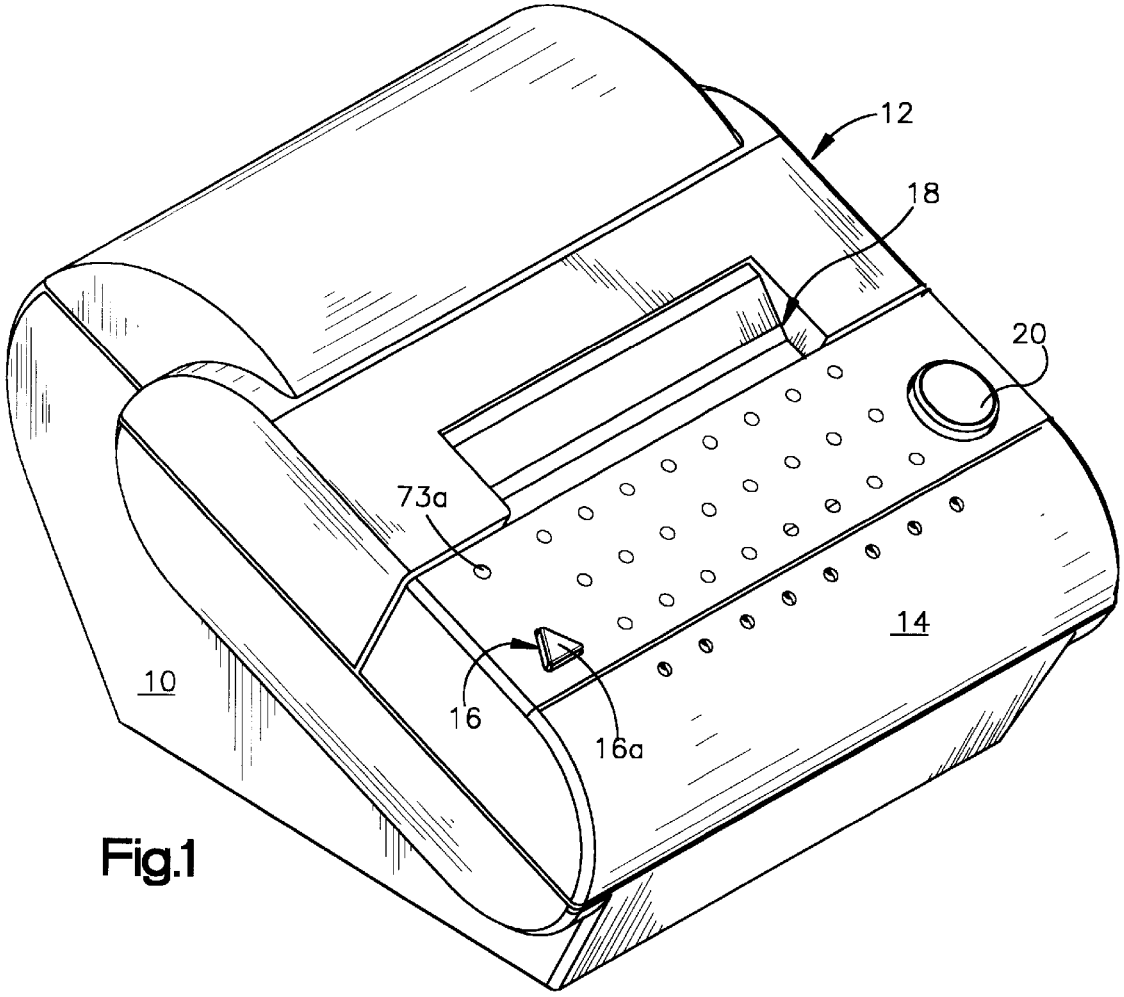
FIG. 1 is a perspective view of a printer apparatus constructed in accordance with the preferred embodiment of the invention.

FIG. 1 illustrates the overall construction of a printing apparatus embodying the present invention. In the illustrated embodiment, the printing apparatus comprises a clam shell-type printer. The printer includes a base 10, a hinged cover 12 which, when opened, provides access to a paper supply compartment 13 (shown in FIG. 1A), and a fixed, but removable cover 14 that encloses a printhead assembly and an optional cutter 15 (shown best in FIGS. 1A and 2. A feed button 16 is actuatable by a user and is operative to advance print media out of an ejection slot indicated generally by the reference character 18. A cover release button 20 is provided for releasing a latch mechanism that maintains the cover 12 in its closed position as illustrated in FIG. 1.

Figure 2:
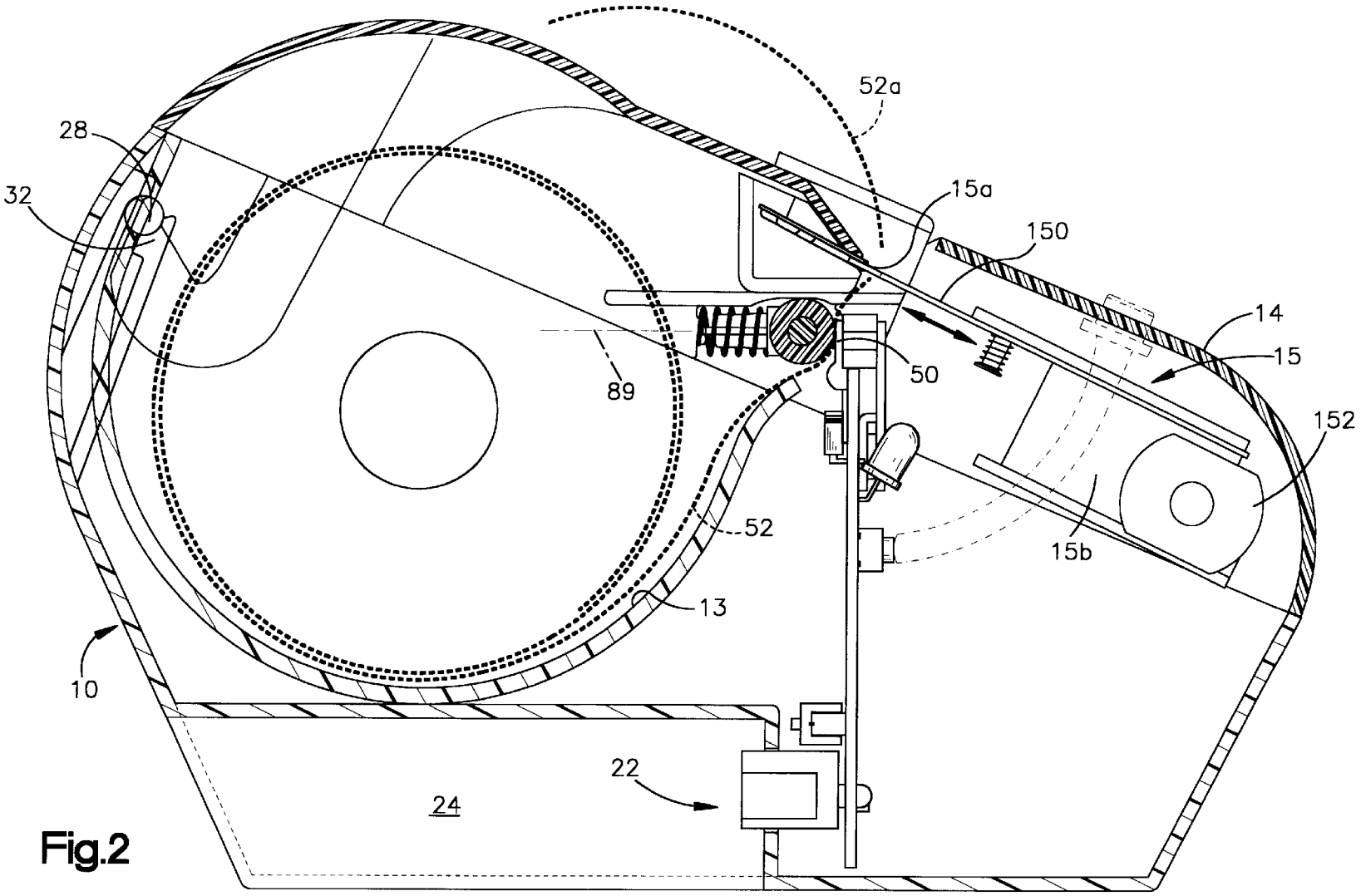
FIG. 2 is a side cross-sectional view of the printer.

Referring also to FIG. 2, connectors to be described and indicated generally by the reference character 22 are provided by which the printer is connected to power and a host system such as a cash drawer of a point of sale terminal (not shown). In the illustrated embodiment, the connectors 22 are accessible underneath the printer by means of a recess 24 formed in the base 10 of the printer.

Figure 3:
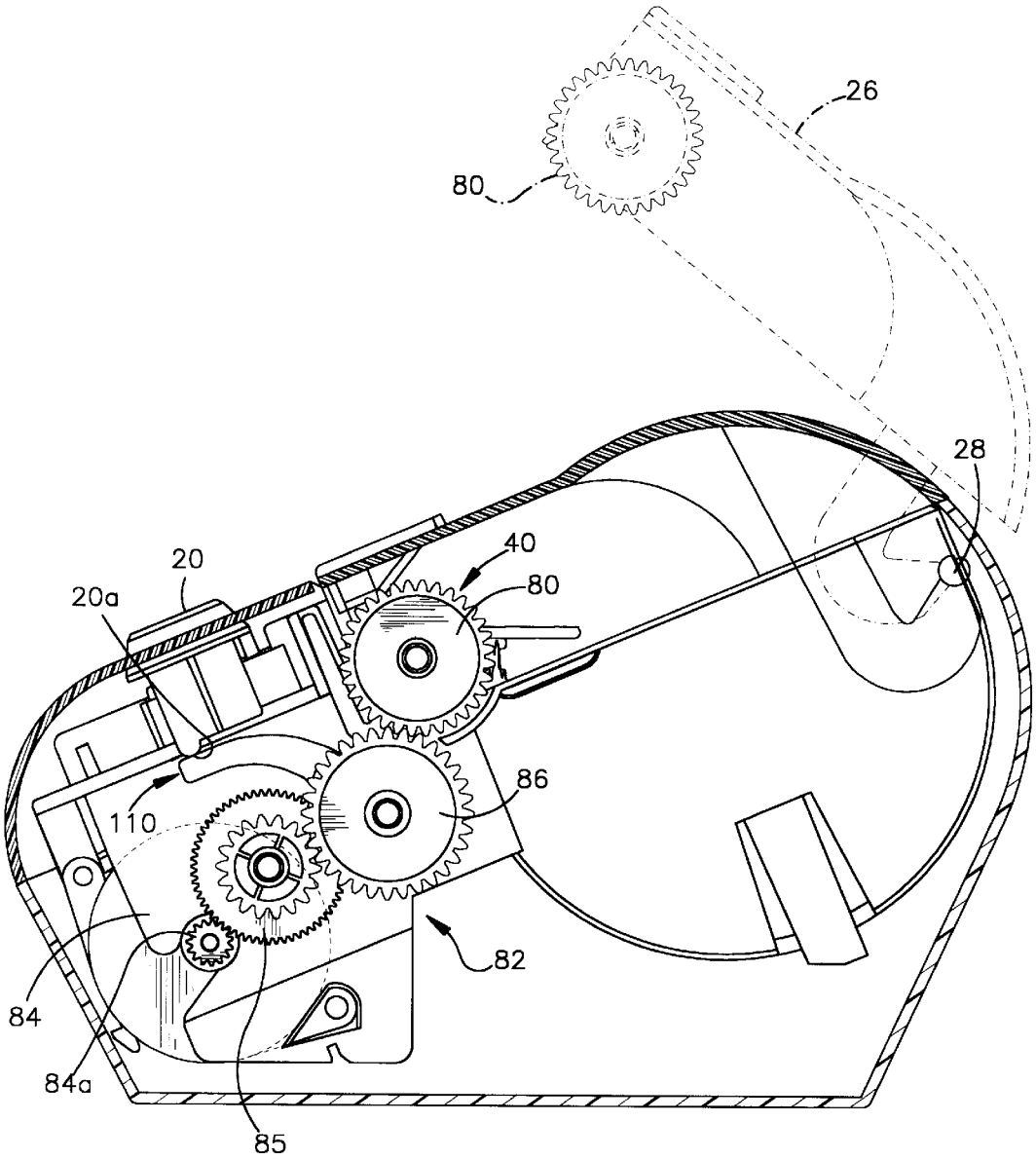
FIG. 3 is another side cross-sectional view of the printer.
Figure 8:
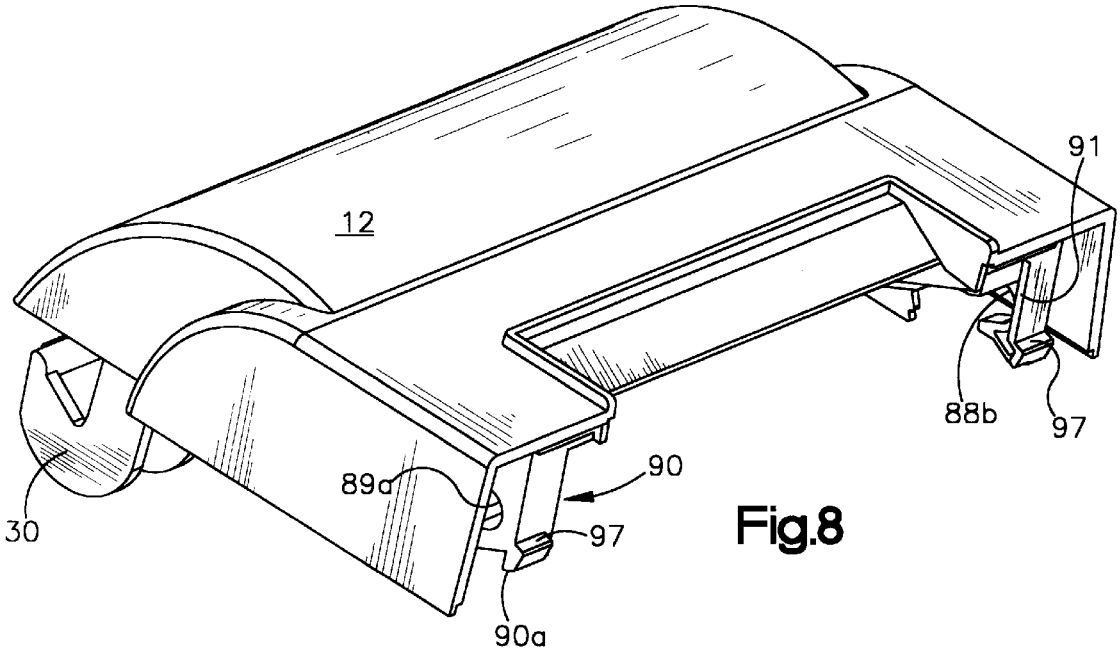
FIG. 8 is a perspective view of a removable cover forming part of the printer.

Referring also to FIG. 3, the cover 12 is rotatable between opened and closed positions about a pivot axis 28. The opened position is shown in phantom and is indicated by the reference character 26. In the preferred embodiment, the cover is separable from the rest of the printer after it is moved to the opened position. Referring also to FIG. 8, this feature is facilitated by a pair of J-shaped hinge members 30, which are engageable with slots 32 formed in the base 10 (shown in FIG. 1A.

According to the invention, the cover mounts a spring biased platen roller 40 (see FIG. 1A and 9A) which is operably engageable with a thermal printhead 50 mounted at a fixed position within the base 10 of the printer. As is conventional, print media (such as paper) 52 (FIG. 2) is fed past the printhead 50 by rotation of the platen roller 40. Heating elements forming part of the printhead are selectively energized to produce indicia, i.e., alphanumeric characters, symbology, barcodes, etc. on the print media 52. Unlike prior printers of this type, the thermal printhead 50 itself is not moveably biased towards the platen roller 40. As is known, in order for the thermal printing process to perform properly, the print medium must be clamped tightly between the platen roller 40 and the printhead 50, as the print medium moves past the printhead. In the device of the present invention, the platen roller 40, not the printhead 50, is spring biased in order to produced the required clamping force.

Figure 4:
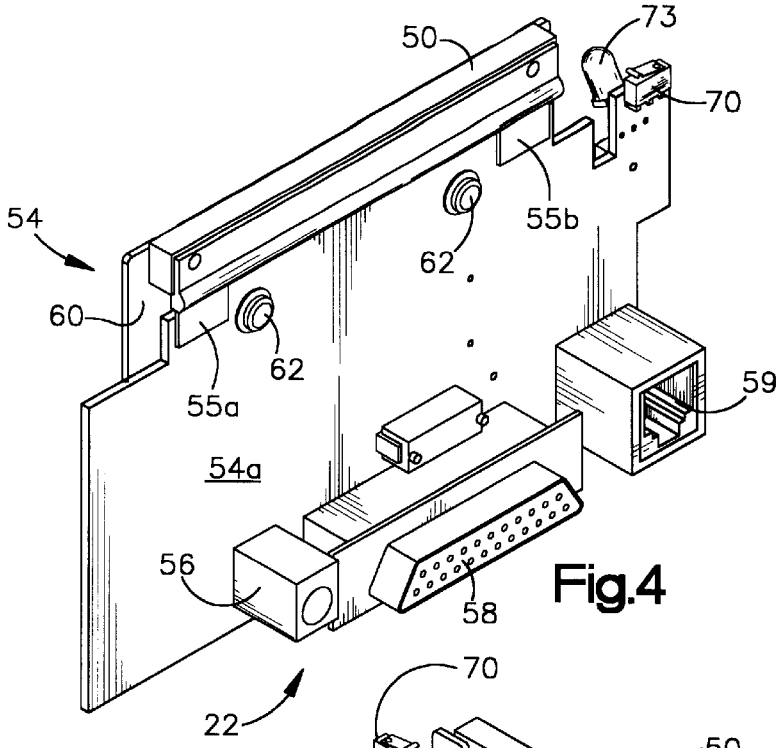
FIGS. 4–6 show three different views of a control module assembly forming part of the printer.
Figure 5:
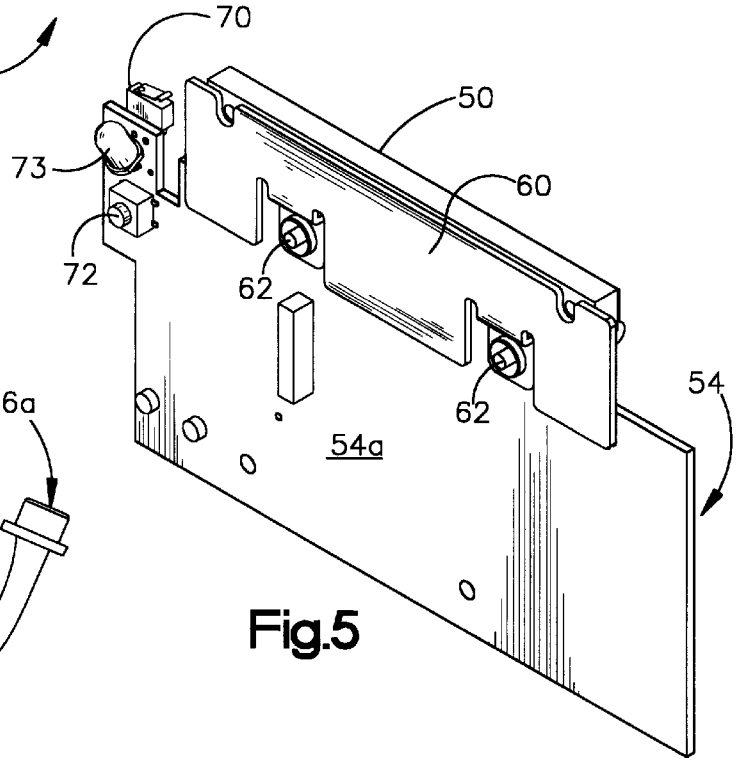
Figure 6:
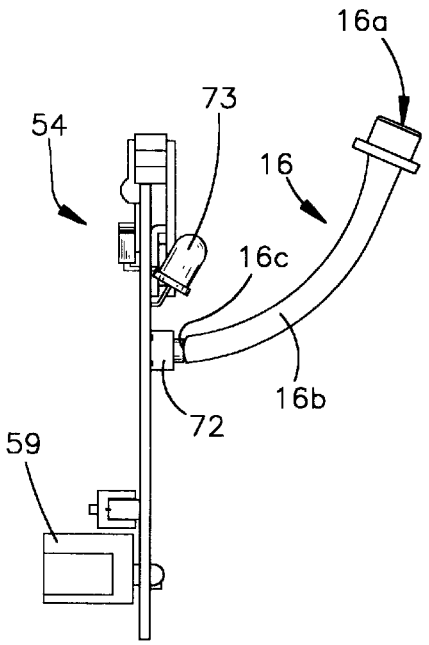

Referring to FIGS. 4–6, the thermal printhead 50 forms part of a control module or circuit board assembly 54 that also mounts the control electronics and may even include the power supply for the electronics and the printhead. In the illustrated construction, the power supply does not form part of the assembly 54 due to space constraints.

In the preferred embodiment, the printhead 50 is attached to a circuit board 54*a* by solder connections 55*a*, 55*b* made between connecting pins of the thermal printhead 50 and contacts or circuit traces made on a circuit board 54*a*. A support bracket 60 is secured to the circuit board 54*a* by fasteners 62 and serves as a mechanical support and rigidizes the mounting of the thermal printhead 50. As seen best in FIG. 4, the circuit board is electronically coupled to, and mechanically mounts the connectors 22, which may include a power connector 56, a communications port in the form of a parallel port connector 58, and a cash drawer connector 59 by which the printer is interfaced to a host system, such as a point of sale machine. The parallel port 58 may be in the form of a DB25 connector. The power connector is adapted to receive a removable jack or plug forming part of a "power cube" which is usually plugged into an A.C. outlet. The connector 59 may be in the form of a RJ11 or RJ45 jack. It should be noted that other forms of connectors are contemplated by the present invention. For example the communications port may a serial port or alternatively may be a more generic communications port to which a serial or parallel module (not shown) is attached, which determines the type of communication that will be used by the printer.

Referring also to FIG. 5, the circuit board 54*a* also rigidly mounts a cover open microswitch 70 which is mechanically actuated by an actuating protrusion (to be described) forming part of the cover 12. The board assembly 54 also includes a print media feed switch 72 (which activates the print media transport to advance the print media). The feed switch 72 is mechanically actuated by the feed button 16, shown in FIGS. 1, 1A, as will be explained. The assembly also includes a LED 73 directly mounted to the board 54*a* and which is visible through an opening 73*a* (See FIG. 1) in the housing 14. In the preferred embodiment the light from the LED 73 is transmitted to the opening 73*a* by a light pipe (not shown) that is mounted at the location indicated by the reference character 75 in FIG. 1A. The mounting arrangement eliminates cabling between the LED 73 and the board 54*a*.

The disclosed control module assembly 54 substantially reduces the manufacturing costs of the printer, since it eliminates connectors and cabling between the printhead 50 and the control electronics, which are typically found in thermal printers. In addition, cabling between external ports and connectors are eliminated, as well as cabling between control switches, status indicators i.e. LED 73 and the control board. As should be apparent, the board serves as a mounting point for both the thermal printhead 50, as well as the required control switches, LED's and connectors.

The platen roller 40 is rotatably supported in the cover 12 and includes a driven gear 80 located at one end. Referring in particular to FIG. 3, when the cover is moved to its closed position (shown in FIG. 1), the driven gear 80 engages a gear train, indicated generally by the reference character 82 located within the base 10. The gear train 82 is coupled to a drive motor 84 and includes a cluster gear 85 directly driven by the motor 84 having an output gear 84*a* which in turn rotates a drive gear 86 that couples with the platen gear 80 when the cover 12 is closed. In the preferred embodiment, the driven gear 80 of the platen roller 40 engages the drive gear such that the engagement occurs at a tangent line that is substantially parallel to the line of action defined by the platen roller mounting in the cover.

The platen roller 40 is spring loaded and is laterally movable with respect to the fixed printhead 50. Referring in particular to FIGS. 2, 9, 9A and 11A, the platen roller 40 is supported by spaced apart slots 88*a,* 88*b* (see also FIG. 8) formed in the hinged cover 12. The slots allow the platen roller 40 to move towards and away from the printhead 50 along a line of action indicated by the reference character 89 in FIG. 2.

Figure 9:
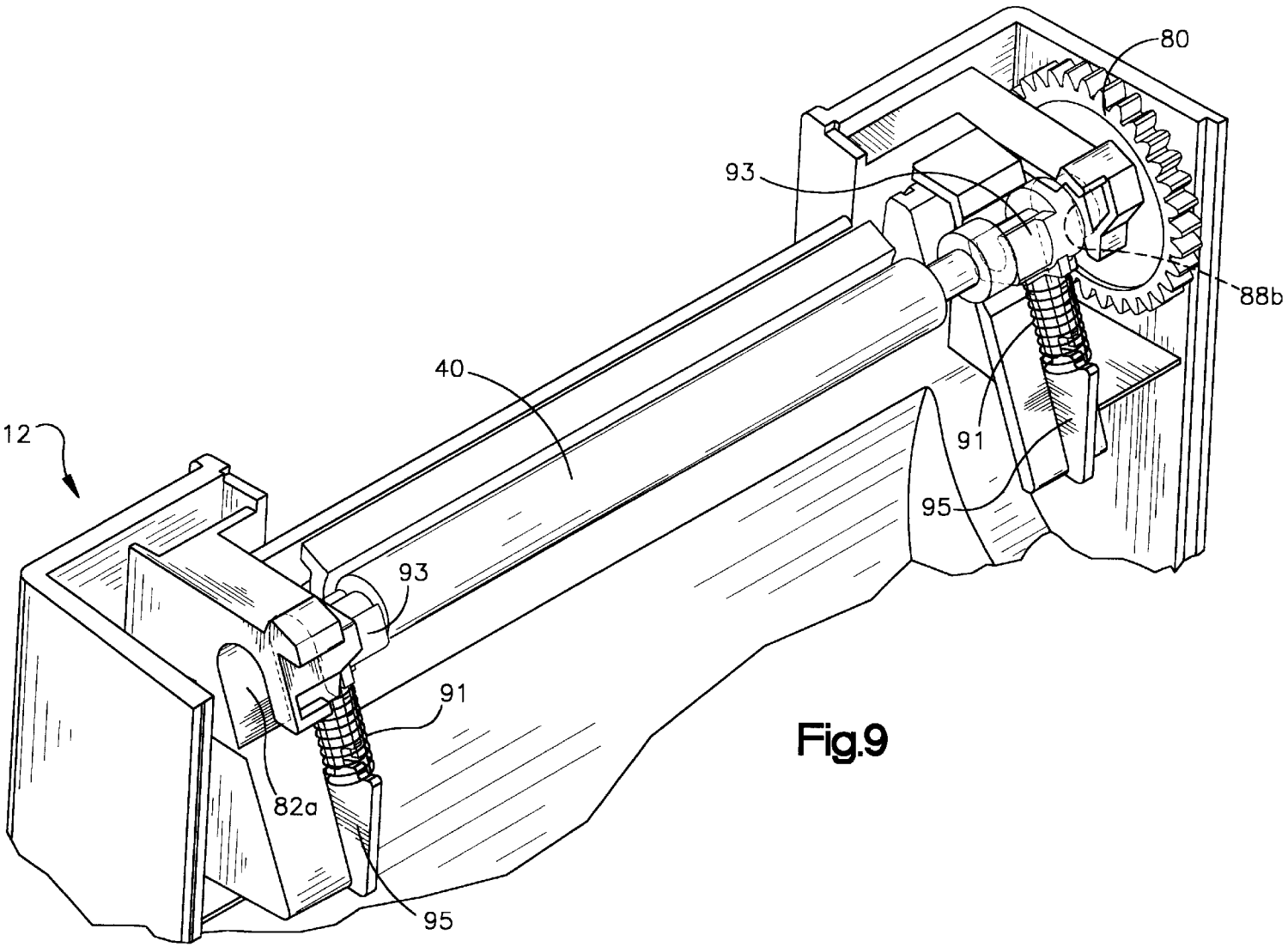
FIG. 9 is a fragmentary, perspective view of the printer cover shown in FIG. 8.
Figure 9A:
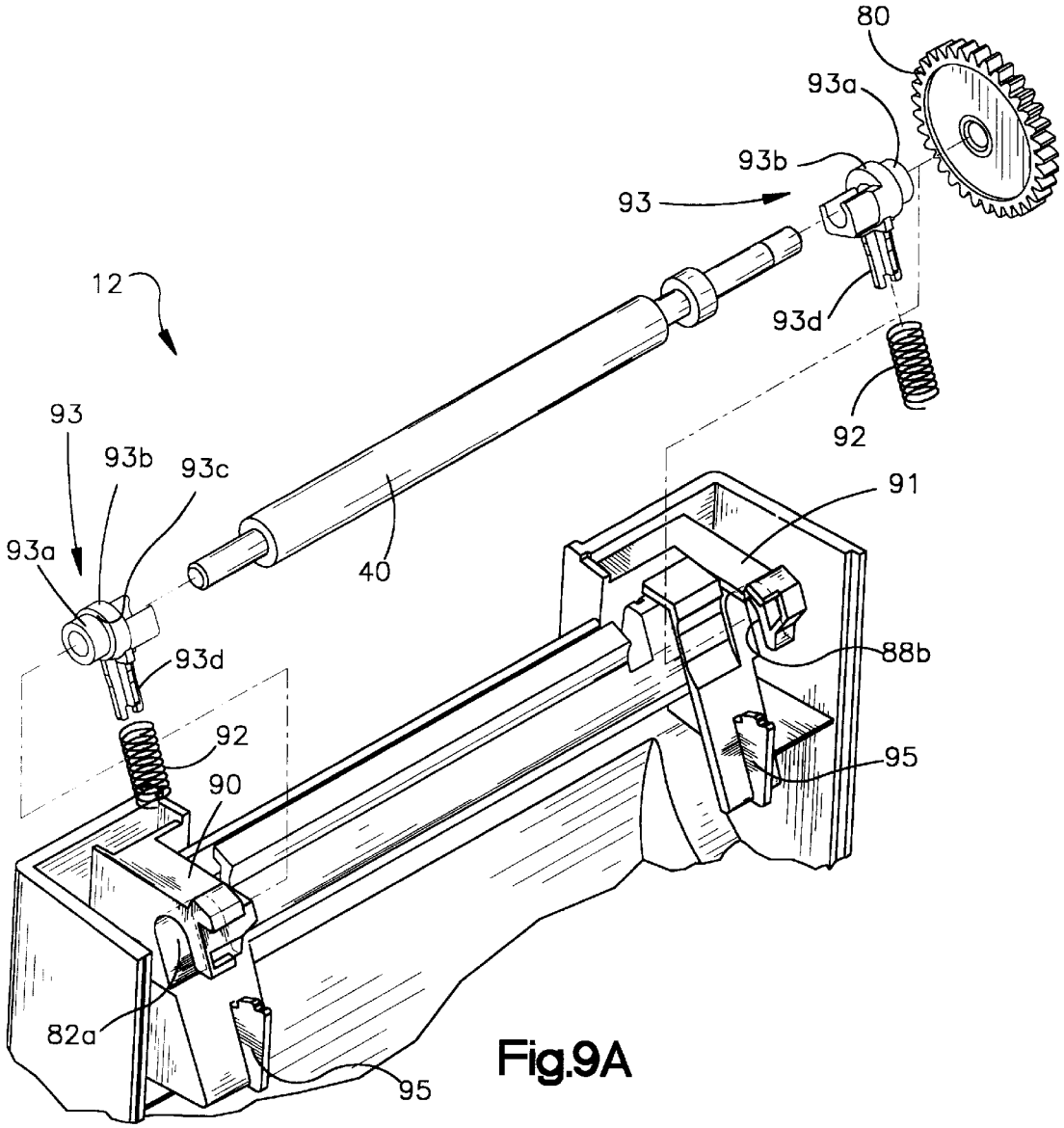
FIG. 9A is an exploded view of the printer cover shown in FIG. 9.

As seen best in FIGS. 9 and 9A, the platen roller 40 is biased towards the printhead 50 by a pair of springs 92 which act between bushings 93 carried by the platen roller and ribs 95 formed in the cover. As seen best in FIG. 9A, the bushings include a narrow diameter portion 93*a* which is sized to fit within an associated slot. An enlarged portion 93*b* defining a side surface 93*c*. The side surface 93*c* is engageable and rides against a side surface of the associated slot and locates the axial position of the platen roller with respect to the cover 12 so that lateral movement (i.e., movement in a direction 90° to the line of action 89 is inhibited).

Each bushing 93 also includes an extension 93*d* which is sized to fit within its associated spring 91 and serves to maintain the position of the spring between its associated bushing 93 and the abutment 95.

The line of action 89 defined by the slots 88*a,* 88*b* is substantially parallel to a tangent line located at the engagement point between the driven gear 80 and drive gear 86. As a result, movement of the platen roller 40 towards and away from the thermal printhead 50 (when the cover 12 is closed) to accommodate variations in dimensional tolerances, as well as variations in print media thickness, do not cause the driven gear 80 to disengage the drive gear 86.

Although biasing the platen roller 40 using spring elements directly acting between the cover and the platen roller 40 is a preferred embodiment, the present invention contemplates other arrangements for producing a biasing force on the platen roller 40. Cover constructions/mountings may be employed which indirectly generate a biasing force on the platen roller 40, for urging it towards operative contact with the printhead 50. In short, those skilled in the art will recognize that the illustrated springs which act between the cover and the platen roller 40, via the bushings 93, may be replaced with components that indirectly bias the platen roller 40 towards the printhead 50.

According to a feature of the invention, the cover open switch 70 mounted to the printhead board assembly 54 is actuated by a protrusion 90*a* formed on the end of a cover latch member 90 (see FIG. 8) on the cover 12 which is operative to actuate the switch 70 as the cover moves to its closed position. The cover includes another latch member 91 that does not include a similar protrusion. As seen best in FIG. 8 and 9A, the latch members 90, 91 from at least part of the slots 88*a*, 88*b*, which as described above movably supports the platen roller 40 for movement towards and away from the printhead 50. The latch members 90, 91, as will be detailed below, form part of a cover latching system by which the cover 12 is maintained in its closed position.

In the preferred embodiment, a tolerance compensating member 94 (see FIGS. 1A, 11A and 11B) is located intermediate the cover open switch 70 and the protrusion 90*a*, when the cover 12 is closed. In the more preferred embodiment, the tolerance compensating member 94 is a foam element which is compressible. The foam element is used to compensate for variations in the gap between the actuating protrusion 90*a* of the cover latch member 90 and the position of the cover open detect switch 70. With the disclosed construction, precise adjustments between the cover actuating protrusion 90*a* and the microswitch 70 in order to effect proper operation when the cover is closed, are not required. The foam member located between the latch member 90 and switch 70 compensates for variations in gap distances between the protrusion 90*a* and switch 70 which normally occur in manufacture.

Figure 11A:
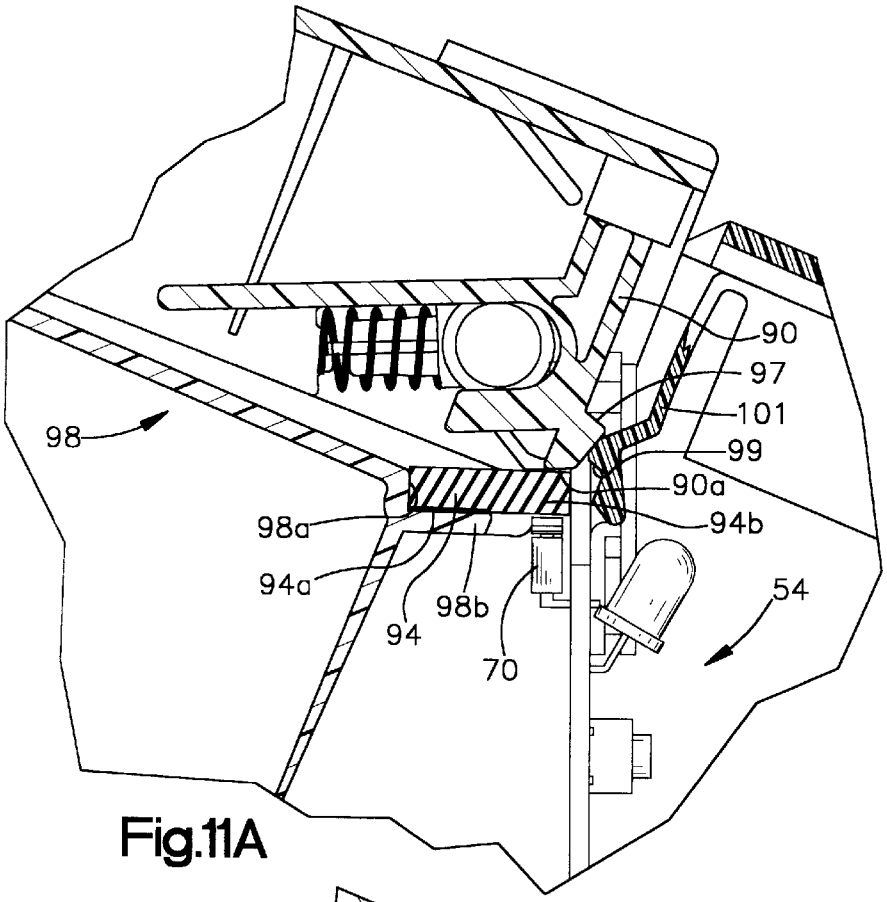
FIGS. 11A and 11B are fragmentary side views showing a cover open detector switch arrangement constructed in accordance with a preferred embodiment of the invention.
Figure 11B:
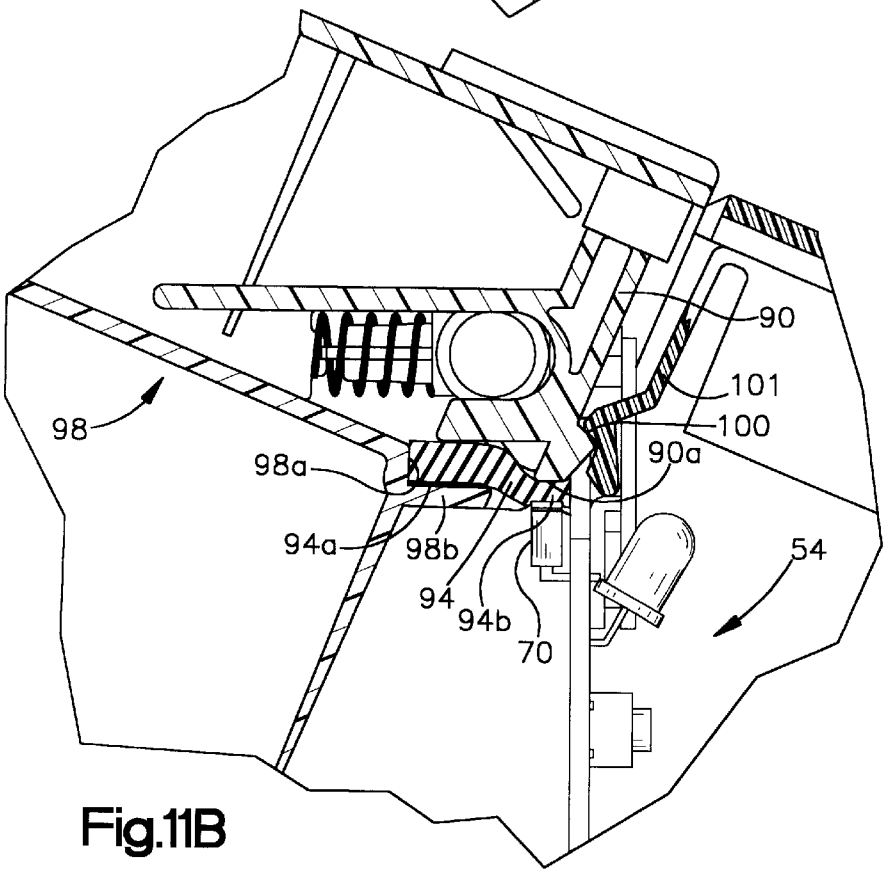

As seen best in FIGS. 11A and 11B, a rectangular-shaped foam member 94 is located in an opening 98*a* defined by an interior housing 98 of the printer. The foam member is positioned such that it overlies the cover open switch 70 mounted to the control module assembly 54. In the illustrated embodiment, a portion 94*a* of the underside of the foam element 94 is secured to a shelf 97 as by adhesive or other suitable means. The remaining portion 94*b* of the element 94 is cantilevered above the switch 70. When the cover 12 is closed, and as seen best in FIG. 11B, the latch member 90 including the downwardly extending protrusion 90*a* contacts the cantilevered portion 94*b* of the foam element. As the cover 12 is moved to the closed position (shown in FIG. 11B), the protrusion 90*a* pushes the foam element 94 towards the switch 70 thereby causing its actuation. Variations in the final gap between the protrusion 90*a* and the microswitch 70 are taken up by the foam.

The cover 12 is latched in its closed position by the latch members 90, 91. The latch members 90, 91 include latching surfaces 97. The intermediate housing 98, as seen best in FIGS. 10A and 11B, includes a pair of latch pawls 101, 102 having a complemental latch surfaces 99 which are engageable with the latching surfaces 93 formed on the cover latch members 90, 91. The engagement between the latch surface 97 and the latch surface 99 is best shown in FIG. 11B and is indicated by the reference character 100. According to the invention, a mechanism is provided for releasing the latch pawls 101, 102 without requiring excessive application force by the operator.

Figure 1A:
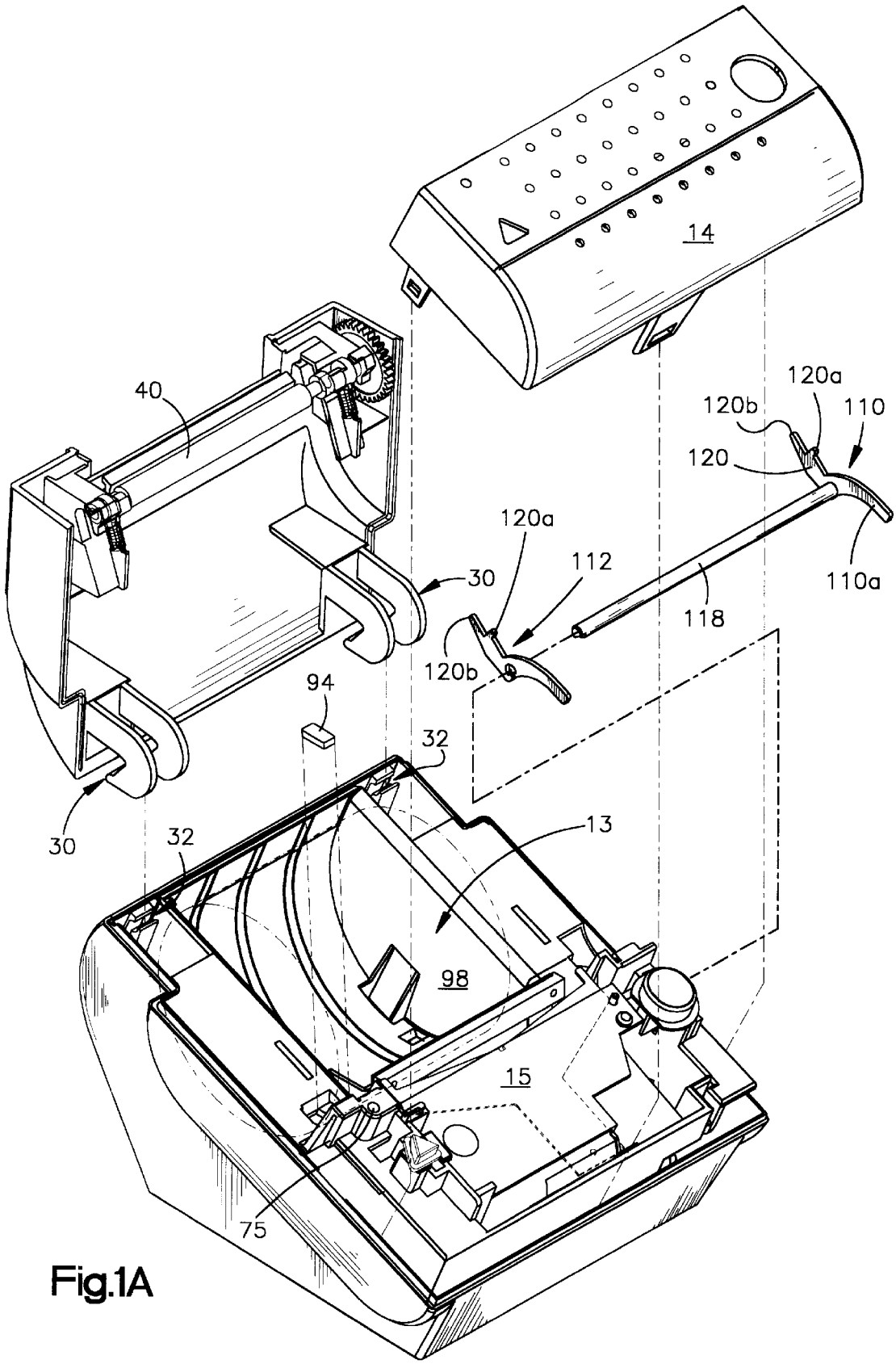
FIG. 1A is an exploded view of the printer shown in FIG. 1, showing separation of removable covers from a base portion of the printer.
Figure 10:
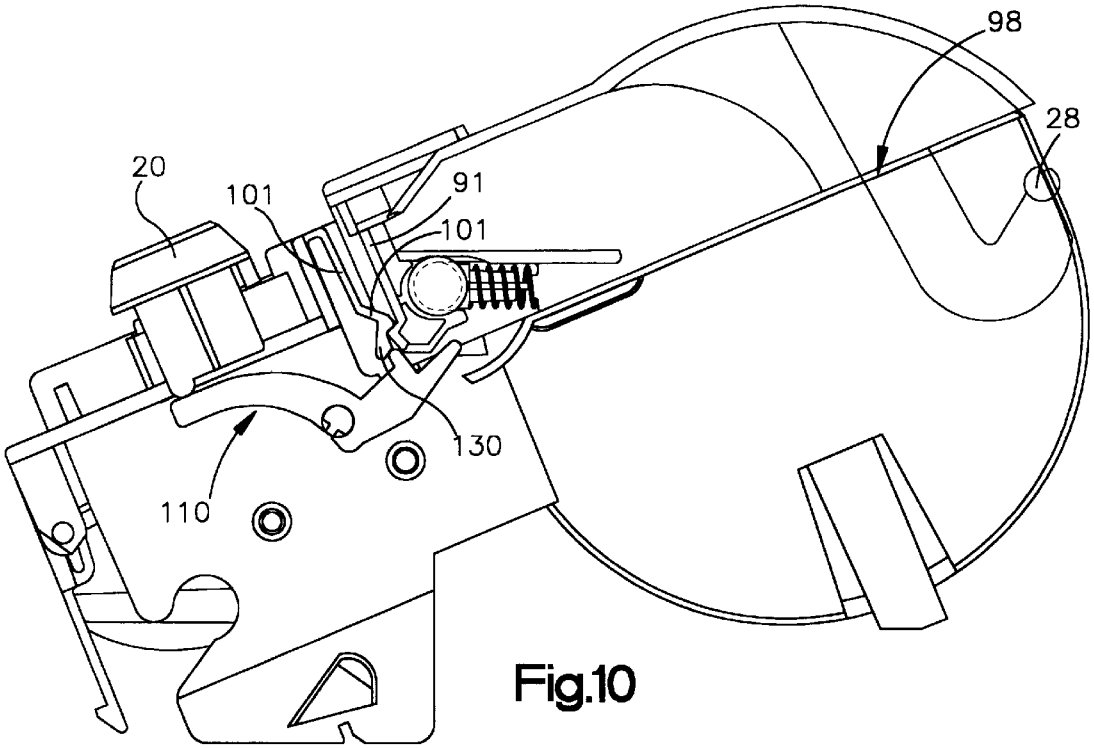
FIG. 10 is a side view of an internal housing member forming part of the printer.
Figure 10A:
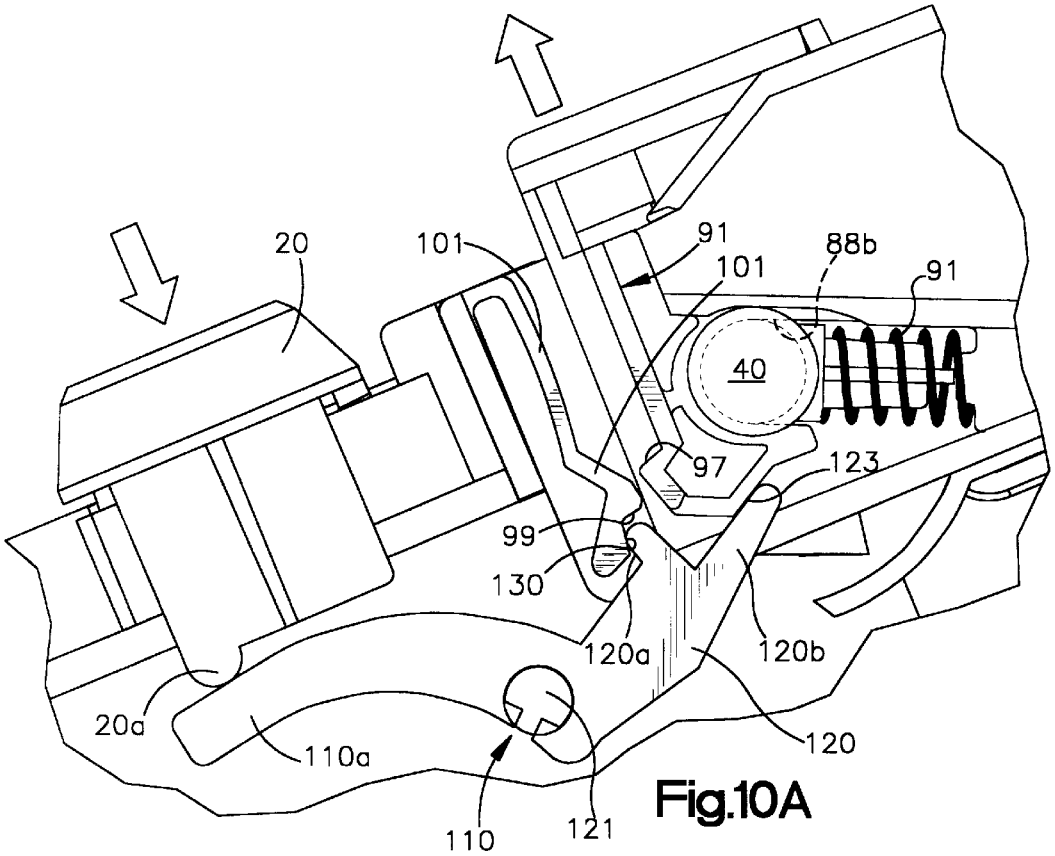
FIG. 10A is a fragmentary side view showing a cover unlatching mechanism.

Referring to FIG. 1A, a cover unlatching mechanism comprising a pair of spaced apart lever arms 110, 112 is located and pivotally supported in the internal housing 98. The lever arms 110, 112 are interconnected by a shaft 118, so that they rotate in unison about an axis 121 (see FIG. 10A) defined by the shaft 118. Referring also to FIGS. 10 and 10A, the latch arm 110 defines a first actuating lever portion 110*a,* which receives forces from the cover open button 20 via tab 20*a*. The application of force to the first lever portion 110*a* rotates the lever 110 and hence the lever 112 (see FIG. 1A) in a counterclockwise direction as viewed in FIG. 10A. Each lever arm 110, 112 includes a second lever portion 120 located on the other side of the pivot axis 121. Downward movement in the first lever portion 110*a* causes the second lever portions 120 to move upwardly. The second lever portions each include a vertically extending pin-like portion 120*a* and a laterally extending finger portion 120*b*.

Referring to FIG. 10A, the pin-like portion 120*a* is operative to engage a caming surface 130 on its associated latch pawl causing the latch pawl to move or bend leftwardly (as viewed in FIG. 10A). This movement tends to disengage the latch pawl surface 99 from the latch surface 97 located on its associated cover mounted latch member. Concurrently, with moving the latch pawls 101, 102 towards the left, the laterally extending finger 120*b* of each lever 110, 112 tends to exert upward forces on an abutment surface 123 formed on the cover mounted latch members 90, 91 thereby effecting opening of the cover 12. The combination action provided by the lever arrangement reduces the effort needed to open the cover by depressing the cover open button 20.

Figure 12:
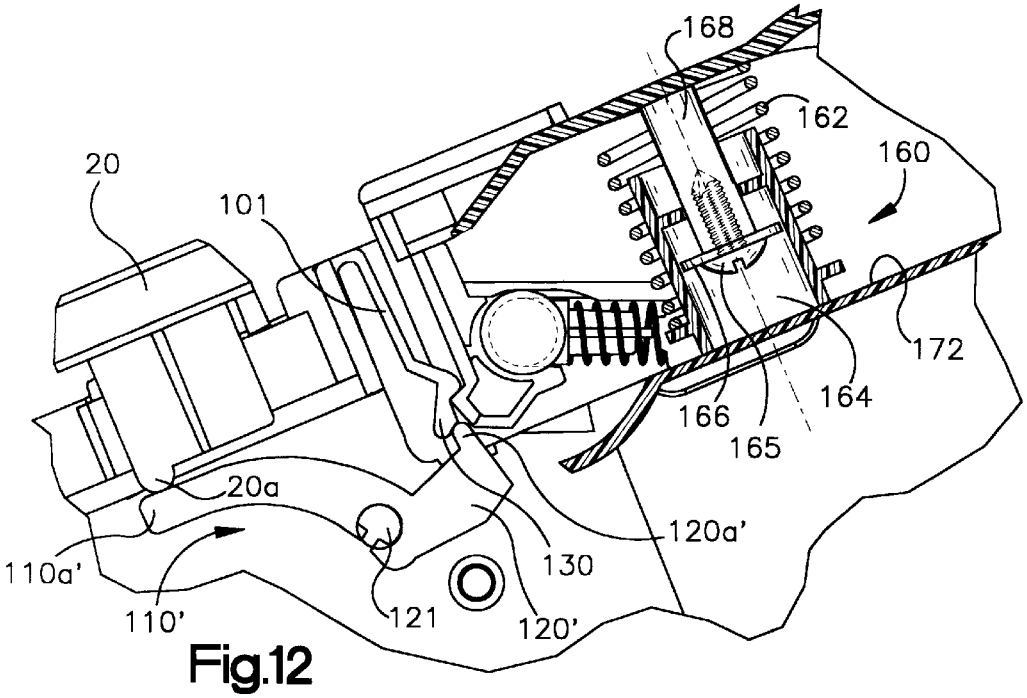
FIG. 12 is a fragmentary side view, partially in section showing an alternate cover latching mechanism of the present invention.
Figure 13:
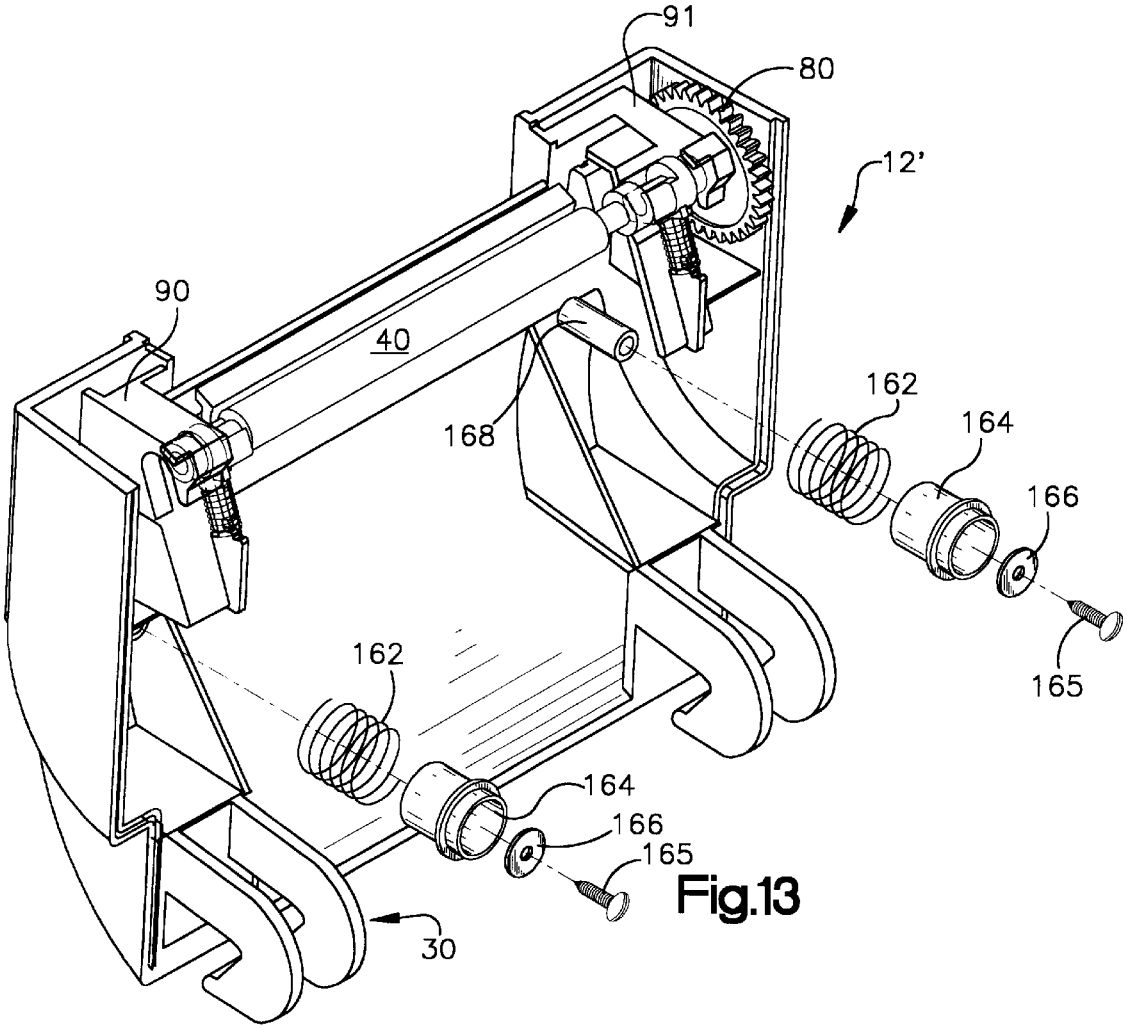
FIG. 13 is a perspective view of an alternate printer cover.

FIGS. 12 and 13 illustrate an alternate embodiment for the cover latching mechanism. In this embodiment, a spring arrangement is used to pop open a cover 12' when the cover open button 20 is pressed. As seen best in FIG. 12, a latch arm 110' is rotated about a pivot 121 whenever the button 20 is depressed. The forces from the button 20 are applied to a first lever portion 110*a*' via tab 20*a*. A second lever portion 120' operates like the lever portion 120 in FIG. 10*a* to move the latch paw 101 leftwardly in order to disengage the cover 12'. Once disengagement occurs, a pair of spring members indicated generally by the reference character 160 operate to raise the cover 12' upwardly so the operator can grasp and lift the cover to its opened position.

Figure 7:
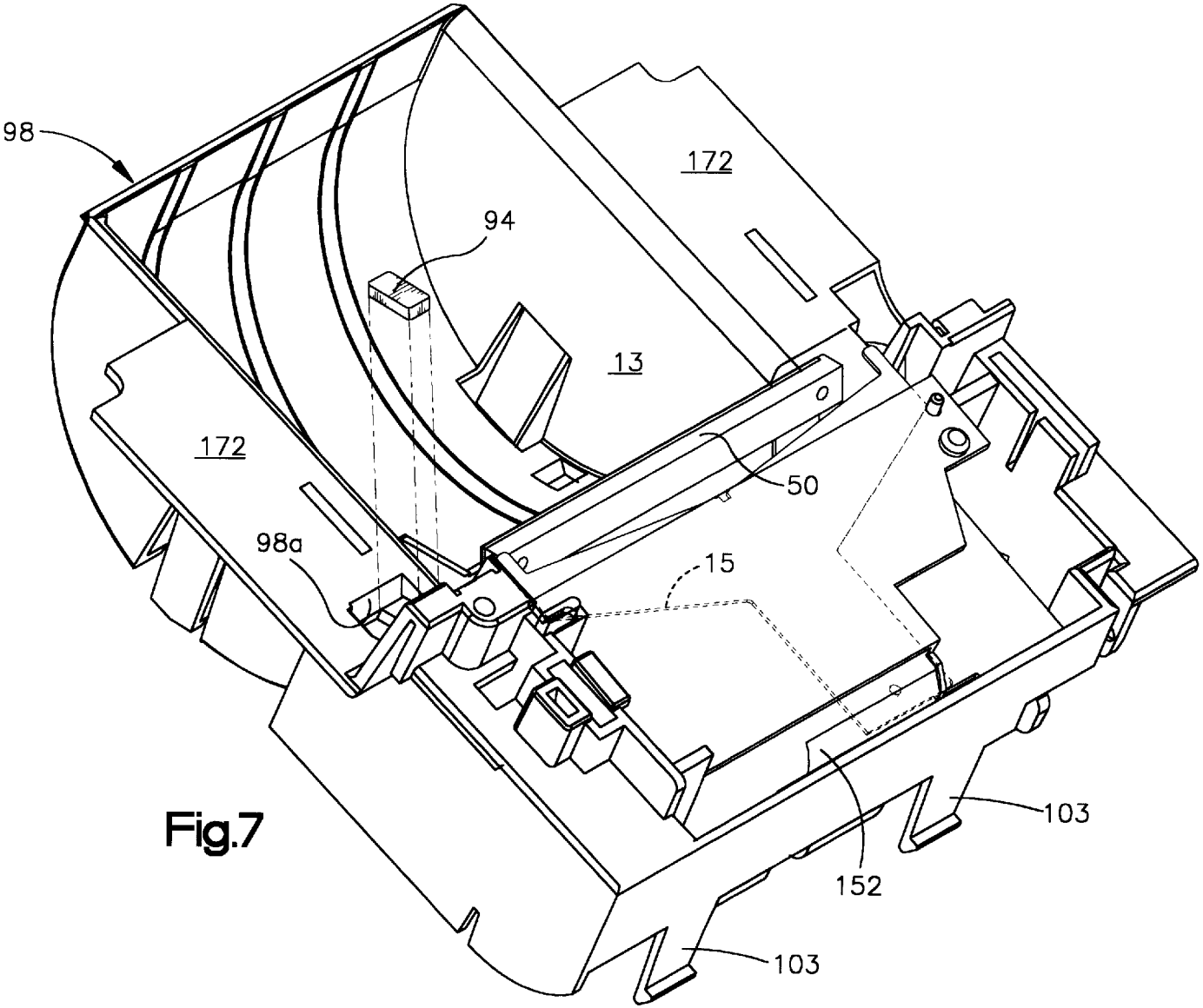
FIG. 7 is a perspective view of an intermediate or internal housing member forming part of the present invention.

Referring also to FIGS. 7 and 13, the spring members comprise compression springs 162 which act between the cover 12' and a cup 164. The assemblage is maintained by a screw 165 and washer 166 which holds the cup 164 to a stanchion 168 formed in the cover 12'. The spring forces act between the cover 12' and side plates 172 forming part of the internal housing member 98 (see FIG. 7).

Figure 7A:
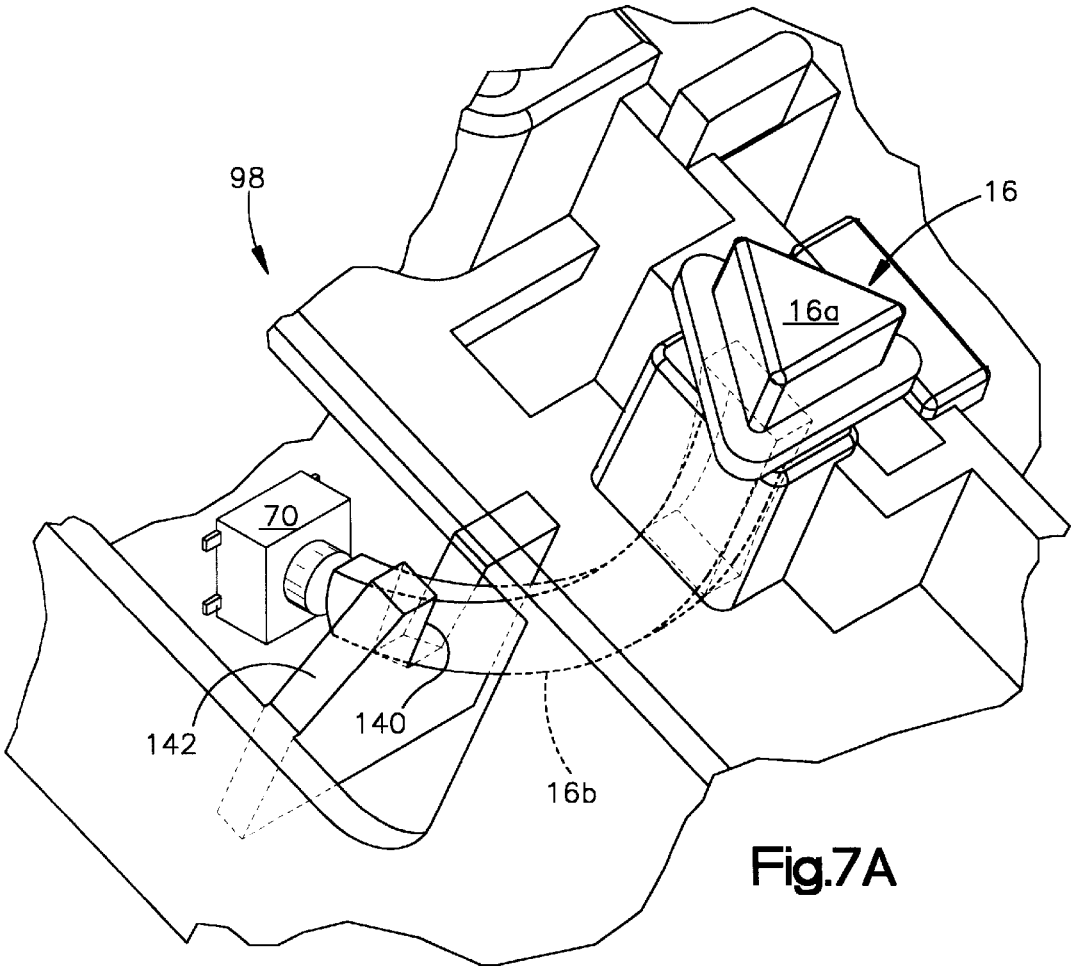
FIG. 7A is a fragmentary, perspective view of the internal housing member shown in FIG. 7 showing a media feed switch mechanism.

The print media feed switch 72 located on the control module assembly is, in the preferred embodiment, directly actuated by the feed button 16 shown in FIG. 1. Referring also to FIGS. 6 and 7A, the button 16 includes a finger receiving portion 16*a* and an elongate arcuate segment 16*b*. The button 16 is slidably held within a channel 140 defined in a locating rib 142 molded into the internal housing 98. The arcuate segment is rectangular in cross-section and is therefore inhibited from rotating with respect to the rectangular shaped channel 140. The coaction between the channel 140 and the segment 16*b* operates to transfer the finger forces applied to the button 16*a* in one direction to a switch closing force exerted by the distal end 16*c* of the button 16 in another direction which is substantially 70° different from the direction of the finger applied force. With the disclosed construction, a remotely mounted print media advancing switch is avoided eliminating the need for cabling and other componentry to connect an actuating button to the switch and, in turn, connect the switch to the control electronics. In addition, by internally mounting the feed switch 72 and actuating it using the elongate feed button 16, susceptibility to electrostatic discharge damage to the circuit board and/or switch is reduced since, in the preferred embodiment, the feed button 16 is molded from a non-conducting, plastic material.

Although the switch has been described as one that produces advancement of print media when actuated, the switch 72 may be used for other functions, such as triggering a self test mode when the printer is first turned on or used as means to initiate a printer configuration mode. The switch 72 should not be limited to a print media advancing function.

Returning to FIGS. 1A and 2, the disclosed printer may be outfitted with the cutter 15. In the preferred embodiment, the cutter 15 includes a fixed blade 15*a* mounted to the cover 12. A moving blade assembly 15*b* is mounted in the base 10 and is enclosed by the removable cover 14. The moving cutter assembly includes a reciprocating blade 150 which moves towards and away from the fixed blade 15*a*. A drive motor 152 forming part of the cutter assembly effects the required reciprocating movement in the blade 150. As seen best in FIG. 2, when the blade moves through its cutting cycle towards and away from the fixed blade 148, a print media portion 52*a* extending through the slot 12 is severed from the remainder of the print media 52.

FIG. 7 illustrates the overall construction of the internal housing 98. The housing is preferably a molded product and includes latches 103 by which it is removably held within the base 10. The internal housing 98 defines, at least partially, the paper supply compartment 13 in which a roll of print media is placed. In the disclosed construction, when the print media 52 needs to be replenished, the cover 12 is opened and a roll of print media is placed within the compartment 12. The leading end of the print media is passed over the printhead and laid atop the cover 14. The cover 12 is then rotated to its closed position at which time the platen roller 40 re-engages the printhead and clamps the print media between itself and the printhead. The end of the print media then extends through the slot 18 which is defined between the rotatable cover 12 and the cover 14. With the disclosed construction, the paper does not have to be fed between paper paths components, i.e., rollers or between components of the cutter (since the fixed blade 15*a* moves out of the paper path when the cover 12 is opened). In the disclosed construction, the fixed blade of the cutter is attached and moves with the cover 12, whereas the reciprocating blade portion of the cutter remains with the base 10.

Figure 14:
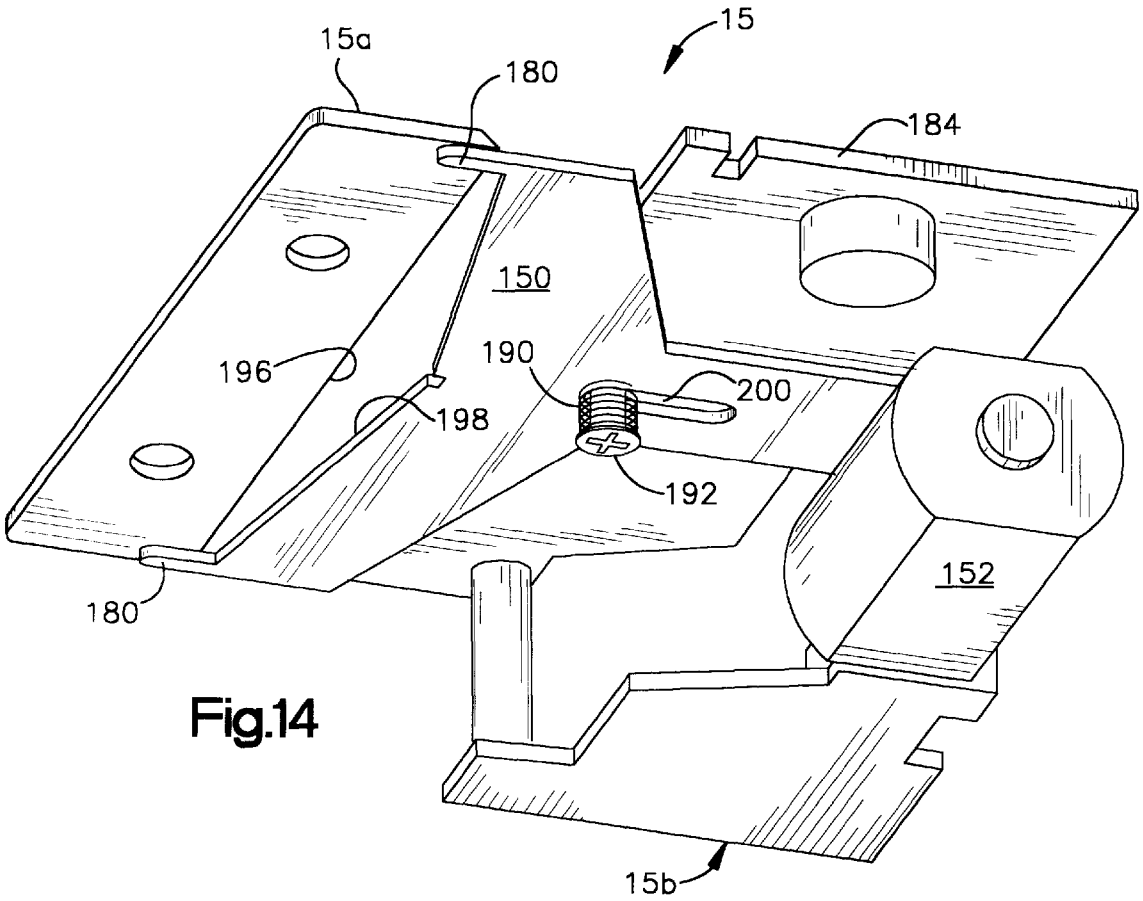
FIG. 14 is a perspective view of a cutter mechanism forming part of the present invention; and, FIG. 14A schematically illustrates an alternate embodiment of a cutter mechanism.

FIG. 14 illustrates, in detail, the preferred cutter mechanism 15. As indicated above, the mechanism includes a fixed blade 15*a* which is mounted to the cover 12. A reciprocating blade 150 is carried by the moving blade assembly 15*b* which is mounted to the base 10 of the printing apparatus. As viewed in FIG. 14, when the cover 12 is opened, the fixed blade 15*a* moves upwardly with respect to the reciprocating blade 150.

To promote uniform contact between the fixed blade 15*a* and the reciprocating blade 150, when the cover is closed, a self-alignment mechanism is provided. In the disclosed embodiment, the blade 150 includes a pair of spaced apart laterally extending ears 180 which contact the underside of the fixed blade 15*a* whenever the cover is closed. The blade 150 itself is at least partially held to a cutter mounting plate 184 by a compression spring and fastener 190, 192 respectively. The spring 190 exerts an upward force on the blade 150 so that contact with the fixed blade 15*a* is maintained while allowing the blade to move (and even rotate slightly) in order to align itself with the blade 15*a*, even if there are slight misalignments between the cover 12 and the base 10. As a consequence, reliable cutting of the print media which passes between a cutting edge 196 of the fixed blade 15*a* and a V-shaped cutting edge 198 of the blade 150 is improved.

As is conventional, when cutting is desired, the motor 152 is energized to move the blade 150 towards and away from the fixed blade 15*a*. A slot 200 formed in the blade 150 allows relative movement between the blade and the fastener 192. In the preferred embodiment, the alignment ears 180 remain in sliding contact with the underside of the blade 15*a* throughout the cutting cycle. It should be noted that this aspect of the invention also contemplates a spring loaded fixed blade 15*a* to provide the self-alignment function.

Figure 14A:
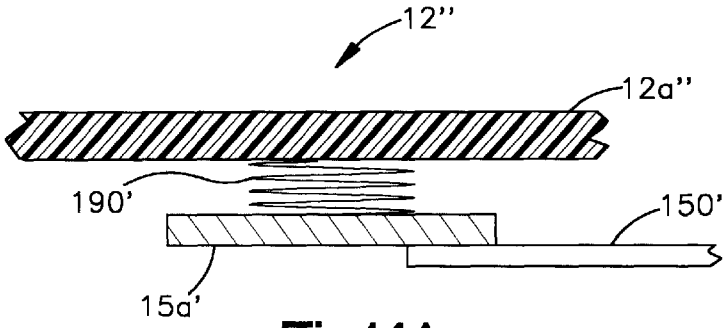

FIG. 14A illustrates an alternate arrangement for biasing the blades towards uniform cutting contact. In the alternate arrangement, a fixed blade 15*a*' is biased towards a reciprocating blade 150' by a spring 190' that acts between the fixed blade 15*a*' and a cover portion 12*a*". The fixed blade 15*a*' is urged into contact with the reciprocating blade 150' whenever the cover 12" is closed.

The disclosed invention provides a very compact and cost effective printer that is easily loaded. Costly and complex cabling between a printhead, control components and interfacing connectors is eliminated or substantially reduced. The disclosed construction also facilitates servicing and component replacement in the printer. In addition, the internal mounting of all of the electronic components including control switches reduces the risk of damage to electronic components due to electrical discharges, etc.

Although the invention has been described with a certain degree of particularity, it should be understood that those skilled in the art can make various changes, alterations and substitutions to the embodiments described herein without departing from the spirit or scope of the invention which is defined by the following claims.

What is claimed is:

1. A printing apparatus, comprising:

a) base portion;

b) a moveable cover for enclosing an interior region of said printing apparatus;

c) a platen roller rotatably supported by said cover, said platen roller including a driven member connectable to a drive source;

d) a control module assembly mounted within said base portion and including a substantially fixed printhead, engageable by said platen roller when said cover is in a closed position, said printhead mounted to a circuit board forming part of said control module assembly and located within said interior region of said printing apparatus;

e) means biasing said platen roller towards said printhead when said cover is in its closed position and allowing said platen roller to move towards and away from said printhead;

f) interface connectors mounted to said circuit board, said connectors being externally accessible and by which said printing apparatus is electronically coupled to other devices; and, g) at least one switch mounted to said circuit board which is actuatable by an actuating element forming part of the printing apparatus, said switch operable to control a function of said printing apparatus;

h) said drive source mounted in said base portion such that when said cover is moved to its closed position said drive source drivingly engages said driven member whereby said platen roller is rotated.

2. The printing apparatus of claim 1, wherein said switch comprises a cover detector switch which detects a position of said cover.

3. The printing apparatus of claim 2, wherein said switch actuating element is actuated by switch actuating structure defined on said cover, when said cover is placed in its closed position.

4. The printing apparatus of claim 3, further comprising a tolerance compensating element interposed between said switch and said switch actuating structure whereby variations in a gap dimension between said structure and said switch is compensated for.

5. The printing apparatus of claim 1, wherein said platen roller biasing means comprises spaced apart springs which act between abutments formed on said cover and spaced locations on said platen roller whereby said platen roller is urged towards operative contact with said printhead when said cover is closed.

6. The printing apparatus of claim 5, wherein said platen roller is slidably mounted in slots formed in said cover which define a line of action towards and away from said printhead, when said cover is closed.

7. The printing apparatus of claim 1, further comprising a cover opening mechanism that includes an operator accessible button which, when pushed, operates a lever mechanism that moves a latch member towards an unlatched position, said cover opening mechanism further including a biasing element for urging said cover towards its opened position.

8. The printing apparatus of claim 1, further comprising a cutter means including a fixed blade portion forming part of said cover and a moving blade portion mounted in said base, said cutter located downstream of said printhead.

9. The printing apparatus of claim 1, wherein said connectors include a power connector, a communications port and a cash drawer connector.

10. The printing apparatus of claim 1, wherein said platen roller includes a driven gear which is engageable with a gear train when said cover is closed, said engagement between said driven gear and said gear train accommodating movement in said platen roller towards and away from said printhead.

11. The printing apparatus of claim 1, wherein said platen roller is rotatably supported in spaced apart bushings which are arranged to be slidably received in slots defined by said cover.

12. The printing apparatus of claim 11, wherein said bushings include side surfaces which axially locate said platen roller within said cover.

13. The printing apparatus of claim 7, wherein said biasing element comprises a portion on said lever mechanism that operable to apply opening forces to said cover.

14. The printing apparatus of claim 7, wherein said biasing element comprises at least one spring that exerts opening forces on said cover when said latch member is moved to said unlatched position by said lever mechanism.

15. A printing apparatus, comprising:

a) a base portion;

b) a cover for enclosing an interior region of said printing apparatus, said cover movable between opened and closed positions;

c) a platen roller rotatably supported by said cover, said platen roller including a driven member connectable to a drive source;

d) a printhead supported by said base portion, in substantially fixed relation thereto, and engageable by said platen roller when said cover is in a closed position; and, e) at least one biasing element for urging said platen roller toward said printhead when said cover is in its closed position, said biasing element comprising a compression, coil spring acting between said cover and a portion of said platen roller, said coil spring allowing said platen roller to move towards and away from said printhead;

f) said drive source mounted in said base portion such that when said cover is moved to its closed position said drive source drivingly engages said driven member whereby said platen roller is rotated.

16. The printing apparatus of claimed 15, further comprising a cutting mechanism including a first cutter portion carried by said cover and a second cutter portion mounted to said base such that when said cover is moved to its opened position, said first portion of said cutting mechanism moves away from said second portion.

17. The printing apparatus of claim 16, wherein one of said cutter portions comprises a fixed blade and the other of said cutter portions comprises a reciprocally movable blade.

18. The printing apparatus of claimed 17, wherein said fixed blade is carried by said cover and said reciprocally movable blade is carried by said base portion.

19. The printing apparatus of claim 15 further comprising a second biasing element, said one and second biasing elements applying forces to end portions of said platen roller.

20. A printing apparatus, comprising:

a) a base;

b) a cover for enclosing an interior region of said printing apparatus, said cover movable between opened and closed positions;

c) said printing apparatus defining a print media path extending from said interior region to a discharge opening, when said cover is in its closed position;

d) a platen roller rotatably supported by said cover, such that when said cover is in its opened position, said platen roller is spaced from said print media path;

e) a substantially fixed printhead supported by said base and engageable by said platen roller when said cover is in its closed position;

f) a biasing arrangement for urging said platen roller toward said printhead when said cover is in its closed position; and, g) a cutter mechanism having one portion carried by said cover and another portion carried by said base such that when said cover is in its opened position, said one portion of said cutter mechanism moves to a spaced location along with said platen roller to facilitate loading of print media into said printing apparatus.

21. The printing apparatus of claim 20 wherein said one portion of said cutter mechanism comprises a fixed blade and said other portion of said cutter mechanism comprises a reciprocally movable blade which cooperates with said fixed blade to sever print media located between said fix blade and said reciprocally movable blade when said cover is in its closed position.

22. A printhead mounting and control module for a printing apparatus, comprising:

a) a support member substantially rigidly mountable within said printing apparatus;

b) a printhead carried by said support member in fixed relation thereto;

c) printhead support electronics carried by said support member;

d) at least one control switch mounted to said support member and operator actuatable by means external to said module; and, e) a light emitting element mounted to said support member;

f a light transmitter for conducting light from said light emitting element to a location spaced from said element so that light emitted by said element can be seen external to said printing apparatus.

23. The printhead mounting and control module of claim 22 wherein said control switch is actuatable by means of an actuating member having an operator engageable portion located external to said printing apparatus.

24. The printhead mounting and control module of claim 22 wherein said printhead comprises a thermal printhead and said support electronics include circuitry for driving said thermal printhead.

25. The printhead mounting and control module of claim 22 wherein said control switch comprises a cover detector switch that detects a position of a cover forming part of said printing apparatus and is actuated by structure defined on a cover forming part of said printer apparatus.

26. The printhead mounting and control module of claim 22 wherein a second control switch is carried by said support member.

27. The printhead mounting and control module of claim 26 wherein said second control switch is a print media advance switch that is actuatable by a separate actuating element carried by said printing apparatus.

28. A printing apparatus, comprising:

a) a base;

b) a cover for enclosing an interior region of said printing apparatus, said cover movable between opened and closed positions;

c) said printing apparatus defining a print media path extending from said interior region to a discharge opening, when said cover is in its closed position;

d) a platen roller rotatably supported by one of said cover and base;

e) a printhead supported by the other of said cover and said base, said platen roller and printhead operatively engageable when said cover is in its closed position;

f) at least one biasing member for urging said printhead and platen roller towards clamping engagement;

g) a cutter mechanism having one portion carried by said cover and another portion carried by said base, such that when said cover is in its opened position, said one portion of said cutter mechanism moves to a spaced location to facilitate loading of print media into said interior region; and, h) resilient alignment member for maintaining alignment of said first portion of said cutter mechanism with said second portion of said cutter mechanism when said cover is in its closed position.

29. The printing apparatus of claim 28, wherein said first portion of said cutter mechanism comprises a fixed blade carried by said cover and said second portion of said cutter mechanism comprises a reciprocally movable blade carried by said base.

30. The printing apparatus of claim 29, wherein said resilient alignment member comprises a spring for exerting forces on said reciprocally movable blade to urge said fixed and reciprocally movable blades into a uniform cutting contact.

31. A printing apparatus, comprising:

a) base portion;

b) a moveable cover for enclosing an interior region of said printing apparatus;

c) a platen roller rotatably supported by said cover;

d) a control module assembly mounted within said base portion and including a substantially fixed printhead, engageable by said platen roller when said cover is in a closed position; and, e) means biasing said platen roller towards said printhead when said cover is in its closed position and allowing said platen roller to move towards and away from said printhead f) at least one switch mounted to said control module assembly which is actuatable by an actuating element forming part of the printing apparatus, said switch comprising a cover detector switch which detects a position of said cover, said switch being actuated by switch actuating structure defined on said cover, when said cover is placed in its closed position; and, g) a tolerance compensating element interposed between said switch and said switch actuating structure whereby variations in a gap dimension between said structure and said switch is compensated for.

32. The printing apparatus of claim 31, wherein said platen roller includes a pair of spaced apart bushings which laterally locate said platen roller within said slots and against which said springs exert biasing forces.

33. The printing apparatus of claim 31, wherein said tolerance compensating element comprises a foam element.

34. A printing apparatus, comprising:

a) base portion;

b) a moveable cover for enclosing an interior region of said printing apparatus;

c) a platen roller rotatably supported by said cover, said platen roller including a driven gear connectable to a drive source;

d) a control module assembly mounted within said base portion and including a substantially fixed printhead, engageable by said platen roller when said cover is in a closed position; and, e) means biasing said platen roller towards said printhead when said cover is in its closed position and allowing said platen roller to move towards and away from said printhead, said platen roller biasing means comprising spaced apart springs which act between abutments formed on said cover and spaced locations on said platen roller whereby said platen roller is urged towards operative contact with said printhead when said cover is closed;

f) said platen roller being slidably mounted in slots formed in said cover which define a line of action towards and away from said printhead, when said cover is closed;

g) said drive source mounted in said base portion and including a drive gear such that when said cover is moved to its closed position said drive gear drivingly engages said driven gear whereby said platen roller is rotated.

35. A printing apparatus, comprising:

a) base portion;

b) a moveable cover for enclosing an interior region of said printing apparatus;

c) a platen roller rotatably supported by said cover;

d) a control module assembly mounted within said base portion and including a substantially fixed printhead, engageable by said platen roller when said cover is in a closed position;

e) means biasing said platen roller towards said printhead when said cover is in its closed position and allowing said platen roller to move towards and away from said printhead;

f) at least one switch mounted to said control module assembly which is actuatable by an actuating element forming part of the printing apparatus; and, g) a second switch mounted to said control module, said switch being directly actuatable by a finger operated button, said button including an elongate actuating arm which extends from a finger applying portion to a proximal location with respect to said second switch.

36. The printing apparatus of claim 35, wherein a housing portion controls movement of said finger operated button such that finger forces applied in one direction produced motion in said second switch in a substantially different direction.

37. A printing apparatus, comprising:

a) base portion;

b) a moveable cover for enclosing an interior region of said printing apparatus;

c) a platen roller rotatably supported by said cover;

d) a control module assembly mounted within said base portion and including a substantially fixed printhead, engageable by said platen roller when said cover is in a closed position;

e) means biasing said platen roller towards said printhead when said cover is in its closed position and allowing said platen roller to move towards and away from said printhead; and, f) a cutter means including a fixed blade portion forming part of said cover and a moving blade portion mounted in said base, said cutter located downstream of said printhead.

38. A printing apparatus, comprising:

a) base portion;

b) a moveable cover for enclosing an interior region of said printing apparatus;

c) a platen roller rotatably supported by said cover, said platen roller including a driven gear connectable to a drive source;

d) a control module assembly mounted within said base portion and including a substantially fixed printhead, engageable by said platen roller when said cover is in a closed position; and, e) means biasing said platen roller towards said printhead when said cover is in its closed position and allowing said platen roller to move towards and away from said printhead;

f) said platen roller being rotatably supported in spaced apart bushings which are arranged to be slidably received in slots defined by said cover;

g) said drive source mounted in said base portion and including a drive gear such that when said cover is moved to its closed position said drive gear drivingly engages said driven gear whereby said platen roller is rotated;

h) said driven gear of said platen roller engaging said drive gear such that the engagement occurs at a tangent line that is substantially parallel to a line of action defined by said slots.

39. A printing apparatus, comprising:

a) a base portion;

b) a cover for enclosing an interior region of said printing apparatus, said cover movable between opened and closed positions;

c) a platen roller rotatably supported by said cover;

d) a printhead supported by said base portion, in substantially fixed relation thereto, and engageable by said platen roller when said cover is in a closed position;

e) at least one biasing element for urging said platen roller toward said printhead when said cover is in its closed position, said biasing element allowing said platen roller to move towards and away from said printhead; and, f) a cutting mechanism including a first cutter portion carried by said cover and a second cutter portion mounted to said base such that when said cover is moved to its opened position, said first portion of said cutting mechanism moves away from said second portion;

g) one of said cutter portions including spaced apart alignment ears engageable with said other cutter portion when said cover is moved to its closed position.

40. A printing apparatus, comprising:

a) a base portion;

b) a cover for enclosing an interior region of said printer, said cover movable between opened and closed positions;

c) said printing apparatus defining a print media path extending from said interior region to a discharge opening, when said cover is in its closed position;

d) a platen roller rotatably supported by said cover, such that when said cover is in its opened position, said platen roller is spaced from said print media path, whereby loading of print media into said printing apparatus is facilitated;

e) a substantially fixed printhead supported by said base portion and engageable by said platen roller when said cover is in its closed position;

f) at least one biasing element for urging said platen roller toward said printhead when said cover is in its closed position, said biasing element allowing said platen roller to move towards and away from said fixed printhead; and, g) a cutter mechanism having one portion carried by said cover and another portion carried by said base such that when said cover is in its opened position, said one portion of said cutter mechanism moves to a spaced location to further facilitate loading of print media into said printing apparatus;

g) one of said cutter portions including spaced apart alignment ears engageable with said other cutter portion when said cover is moved to its closed position.

41. The printing apparatus of claim 40 wherein said interior region at least partially defines a print media supply compartment for supporting a supply of print media.

42. The printing apparatus of claim 40 wherein said printhead comprises a thermal printhead.

43. The printing apparatus of claim 40 further comprising another biasing element, said biasing elements applying forces to respective end portions of said platen roller whereby said platen roller is urged into operative engagement with said printhead, when said cover is in its closed position.

44. The printing apparatus of claim 43 wherein said biasing elements comprise springs which exert forces on bushings that rotatably receive said end portions of said platen roller.

45. A printing apparatus, comprising:

a) a base portion;

b) a cover for enclosing an interior region of said printer, said cover movable between opened and closed positions;

c) said printing apparatus defining a print media path extending from said interior region to a discharge opening, when said cover is in its closed position;

d) a platen roller rotatably supported by said cover, such that when said cover is in its opened position, said platen roller is spaced from said print media path, whereby loading of print media into said printing apparatus is facilitated, said platen roller including a driven gear connectable to a drive source;

e) a substantially fixed printhead supported by said base portion and engageable by said platen roller when said cover is in its closed position; and, f) first and second biasing elements for urging said platen roller toward said printhead when said cover is in its closed position, said biasing elements allowing said platen roller to move towards and away from said fixed printhead;

g) said biasing elements applying forces to respective end portions of said platen roller whereby said platen roller is urged into operative engagement with said printhead, when said cover is in its closed position;

h) said biasing elements comprising springs which exert forces on bushings that rotatably receive said end portions of said platen roller;

i) said drive source mounted in said base portion and including a drive gear such that when said cover is moved to its closed position said drive gear drivingly engages said driven gear whereby said platen roller is rotated.

46. A printing apparatus, comprising:

a) a base portion;

b) a cover for enclosing an interior region of said printing apparatus, said cover movable between opened and closed positions;

c) a platen roller rotatably supported by said cover;

d) a printhead supported by said base portion, in substantially fixed relation thereto, and engageable by said platen roller when said cover is in a closed position; and, e) at least one biasing element for urging said platen roller toward said printhead when said cover is in its closed position, said biasing element comprising a compression, coil spring acting between said cover and a portion of said platen roller, said coil spring allowing said platen roller to move towards and away from said printhead;

f) a first cutter portion carried by said cover;

g) a second cutter portion mounted to said base such that when said cover is moved to its opened position, said first portion of said cutting mechanism moves away from said second portion;

h) one of said cutter portions comprising a fixed blade and the other of said cutter portions comprising a reciprocally movable blade.

47. A printing apparatus, comprising:

a) a base portion;

b) a cover for enclosing an interior region of said printer, said cover movable between opened and closed positions;

c) said printing apparatus defining a print media path extending from said interior region to a discharge opening, when said cover is in its closed position;

d) a platen roller rotatably supported by said cover, such that when said cover is in its opened position, said platen roller is spaced from said print media path, whereby loading of print media into said printing apparatus is facilitated;

e) a substantially fixed printhead supported by said base portion and engageable by said platen roller when said cover is in its closed position;

f) at least one biasing element for urging said platen roller toward said printhead when said cover is in its closed position, said biasing element allowing said platen roller to move towards and away from said fixed printhead; and, g) a cutter mechanism having one portion carried by said cover and another portion carried by said base such that when said cover is in its opened position, said one portion of said cutter mechanism moves to a spaced location to further facilitate loading of print media into said printing apparatus;

h) said one portion of said cutter mechanism comprising a fixed blade and said other portion of said cutter mechanism comprising a reciprocally movable blade which cooperates with said fixed blade to sever print media located between said fix blade and said reciprocal movable blade when said cover is in its closed position.

48. The printing apparatus of claim 47 wherein said other portion of said cutter mechanism includes a drive motor for reciprocally moving its associated blade.

* * * * *